US010597248B2

(12) United States Patent
Hamano et al.

(10) Patent No.: US 10,597,248 B2
(45) Date of Patent: Mar. 24, 2020

(54) MEDIUM FEEDING APPARATUS

(71) Applicant: SEIKO EPSON CORPORATION, Tokyo (JP)

(72) Inventors: Ryo Hamano, Matsumoto (JP); Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 15/463,090

(22) Filed: Mar. 20, 2017

(65) Prior Publication Data

US 2017/0275119 A1 Sep. 28, 2017

(30) Foreign Application Priority Data

Mar. 28, 2016 (JP) ..... 2016-063264

(51) Int. Cl.
*B65H 23/188* (2006.01)
*B65H 23/192* (2006.01)
(Continued)

(52) U.S. Cl.
CPC ..... *B65H 23/1888* (2013.01); *B41J 2/01* (2013.01); *B41J 3/4078* (2013.01);
(Continued)

(58) Field of Classification Search
CPC ..... B65H 23/195; B65H 23/1955; B65H 23/198; B65H 23/188; B65H 23/1888; B65H 23/184; B65H 23/182; B65H 23/1806; B65H 18/085; B65H 18/103; B65H 16/103; B65H 16/10; B65H 2301/415; B65H 2301/41501;
(Continued)

(56) References Cited

U.S. PATENT DOCUMENTS 4,154,396 A * 5/1979 Kirkham ..... G06K 13/20 235/458
5,825,374 A * 10/1998 Albertalli ..... B41J 11/0085 346/136
(Continued)

FOREIGN PATENT DOCUMENTS

EP 1780029 A1 * 5/2007 ..... B41J 15/165
JP H10-16337 1/1998
(Continued)

OTHER PUBLICATIONS

JP4606305(B2) Translation; Osamu, W; Label Printer; Published: Jan. 5, 2011; Espacenet (Year: 2011).*
(Continued)

*Primary Examiner* — Michael R Mansen
*Assistant Examiner* — Raveen J Dias
(74) *Attorney, Agent, or Firm* — Workman Nydegger

(57) ABSTRACT

A medium feeding apparatus includes a feeding portion that performs a feeding operation, which feeds a medium to a downstream side, and a reverse feeding operation, which feeds the medium to an upstream side, and a wind-up portion that performs a wind-up operation, which winds up a medium fed to the downstream side by the feeding operation, and a unwinding operation that unwinds the wound up medium, in which the wind-up portion performs the unwinding operation prior to the reverse feeding operation.

4 Claims, 19 Drawing Sheets

(51) Int. Cl.

| | |
|---|---|
| ***B65H 23/195*** | (2006.01) |
| ***B65H 23/198*** | (2006.01) |
| ***B41J 15/04*** | (2006.01) |
| ***B41J 15/16*** | (2006.01) |
| ***B41J 11/42*** | (2006.01) |
| ***B41J 2/01*** | (2006.01) |
| ***B41J 11/00*** | (2006.01) |
| ***B41J 11/02*** | (2006.01) |
| ***B41J 3/407*** | (2006.01) |
| ***B65H 20/30*** | (2006.01) |

(52) U.S. Cl.

CPC ..... *B41J 11/0095* (2013.01); *B41J 11/02* (2013.01); *B41J 11/42* (2013.01); *B41J 15/04* (2013.01); *B41J 15/16* (2013.01); *B41J 15/165* (2013.01); *B65H 20/30* (2013.01); *B65H 23/188* (2013.01); *B65H 23/192* (2013.01); *B65H 23/195* (2013.01); *B65H 23/198* (2013.01); *B65H 23/1955* (2013.01); *B65H 2515/31* (2013.01); *B65H 2801/12* (2013.01); *B65H 2801/15* (2013.01)

(58) Field of Classification Search

CPC ..... B65H 2301/415085; B65H 2301/4151; B65H 2301/41522; B65H 2301/4165; B65H 23/192; B65H 20/36; B65H 20/38; B65H 20/40; B41J 2002/012; B41J 11/007; B41J 13/0009; B41J 13/03; B41J 15/04; B41J 15/046; B41J 15/048; B41J 15/16; B41J 15/1651

See application file for complete search history.

(56) References Cited

U.S. PATENT DOCUMENTS 6,964,392 B1 * 11/2005 Matsunaga ..... B65H 23/188 226/195
9,333,775 B2 * 5/2016 Kozuma ..... B65H 23/0326
9,802,429 B2 * 10/2017 Kawajiri ..... B41J 11/0095
2004/0156665 A1 * 8/2004 Ng ..... B65H 23/1888 400/578
2007/0059078 A1 * 3/2007 Silverbrook ..... B41J 11/001 400/614
2009/0269119 A1 10/2009 Hatada et al.
2010/0327515 A1 * 12/2010 Nakada ..... B65H 16/10 271/225
2011/0242245 A1 * 10/2011 Okazaki ..... B41J 11/0085 347/104
2013/0015285 A1 * 1/2013 Uruma ..... B65H 18/103 242/420.5
2013/0127943 A1 * 5/2013 Abe ..... B41J 13/0009 347/16
2013/0135415 A1 * 5/2013 Claramunt ..... B41J 11/001 347/104
2014/0132689 A1 * 5/2014 Ishikawa ..... B41J 15/046 347/104
2015/0054895 A1 * 2/2015 Suzuki ..... B41J 15/165 347/104
2015/0328909 A1 * 11/2015 Takizawa ..... B41J 13/0009 347/104
2016/0236890 A1 * 8/2016 Wada ..... B65H 23/198
2017/0087903 A1 * 3/2017 Yamabe ..... B41J 2/01

FOREIGN PATENT DOCUMENTS

JP 2009-280398 A 12/2009
JP 4606305 B2 * 1/2011 ..... B41J 15/16

OTHER PUBLICATIONS

JPH1016337(A) Translation; Hideki. O; Label Printer; Published: Jan. 20, 1998; Espacenet (Year: 1998).*

* cited by examiner

MEDIUM FEEDING APPARATUS

BACKGROUND

1. Technical Field

The present invention relates to a medium feeding apparatus that is provided with a wind-up portion that winds up a medium.

2. Related Art

A printer, which is an example of a medium feeding apparatus, will be described. Among printers, apparatuses that perform a reverse feeding operation (backfeeding) that feeds a medium to an upstream side using a transport roller pair, and a rewinding operation that winds up a medium fed along to the upstream side from the transport roller pair onto a roll body, are known. In these printers, while the rewinding operation of the roll body is initiated after the initiation of the reverse feeding operation by the transport roller pair, the reverse feeding operation and the rewinding operation are finished at substantially the same time (refer to JP-A-2009-280398).

In a medium feeding apparatus that is provided with a wind-up portion that winds up a medium fed to the downstream side from a feeding portion, when a unwinding operation, in which the wind-up portion unwinds a medium, is initiated after the initiation of a reverse feeding operation, in which the feeding portion feeds the medium to an upstream side, there is a concern that the medium between the wind-up portion and the feeding portion will attain a pulled taut state, and that it will not be possible for the feeding portion to suitably perform the reverse feeding operation.

SUMMARY

An advantage of some aspects of the invention is to provide a medium feeding apparatus that can suppress a circumstance in which a medium between a feeding portion and a wind-up portion attains a pulled taut state when the feeding portion performs a reverse feeding operation.

According to an aspect of the invention, there is provided a medium feeding apparatus including a feeding portion that performs a feeding operation, which feeds a medium to a downstream side, and a reverse feeding operation, which feeds the medium to an upstream side, and a wind-up portion that performs a wind-up operation, which winds up a medium fed to the downstream side by the feeding operation, and a unwinding operation that unwinds the wound up medium, in which the wind-up portion performs the unwinding operation prior to the reverse feeding operation.

According to this configuration, the reverse feeding operation is initiated in a state in which the medium has been unwound by the unwinding operation. Accordingly, it is possible to suppress a circumstance in which the medium between the feeding portion and the wind-up portion attains a pulled taut state when the feeding portion performs the reverse feeding operation.

In this case, it is preferable that the medium feeding apparatus further include a unwinding amount detection portion that detects a unwinding amount of the medium by the unwinding operation, and that the wind-up portion stop the unwinding operation in a case in which the detected unwinding amount exceeds a threshold value based on a reverse feeding amount of the medium by the reverse feeding operation.

According to this configuration, it is possible to suppress a circumstance in which an excessive amount of the medium is unwound from the wind-up portion.

In this case, it is preferable that the medium feeding apparatus further include a tension member that applies tension to the medium between the feeding portion and the wind-up portion, and moves toward a unwinding stopping position when the unwinding operation is performed, and a position detection portion that detects the position of the tension member, and that the wind-up portion stops the unwinding operation in a case in which it is detected by the position detection portion that the tension member has reached the unwinding stopping position.

According to this configuration, it is possible to suppress a circumstance in which an excessive amount of the medium is unwound from the wind-up portion.

In this case, it is preferable that the medium feeding apparatus further include a unwinding amount detection portion that detects a unwinding amount of the medium by the unwinding operation, a tension member that applies tension to the medium between the feeding portion and the wind-up portion, and moves toward a unwinding stopping position when the unwinding operation is performed, and a position detection portion that detects the position of the tension member, and that the wind-up portion stops the unwinding operation in a case in which it is detected by the position detection portion that the tension member has reached the unwinding stopping position, and in a case in which the detected unwinding amount exceeds a threshold value based on a reverse feeding amount of the medium by the reverse feeding operation even if it is not detected that the tension member has reached the unwinding stopping position.

According to this configuration, the unwinding operation is stopped at a point in time at which the detected unwinding amount exceeds the threshold value even in a case in which the tension member has not moved toward the unwinding stopping position when the medium is unwound from the wind-up portion. Accordingly, it is possible to suppress a circumstance in which an excessive amount of the medium is unwound from the wind-up portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus 1, which is an embodiment of a medium feeding apparatus of the invention will be described with reference to the appended drawings.

Figure 1:
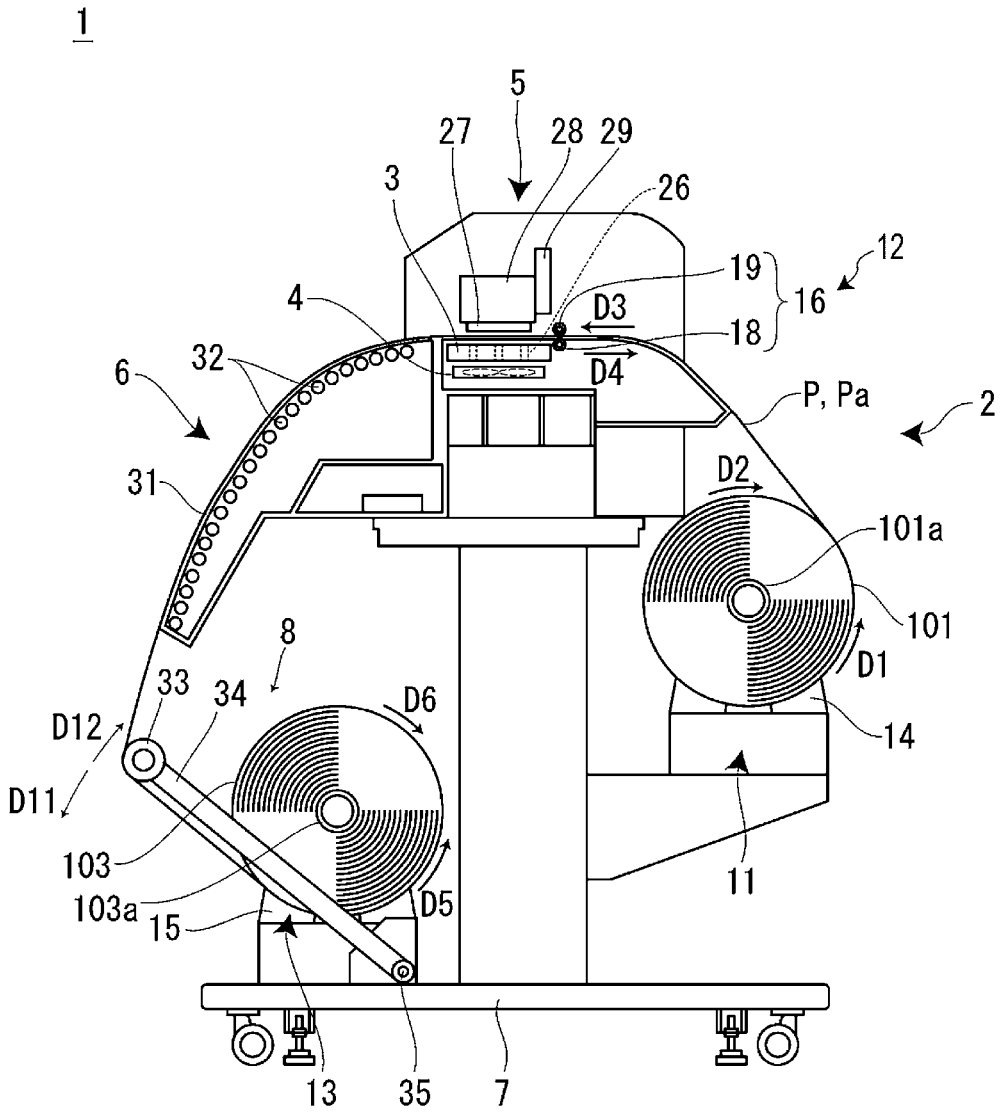
FIG. 1 is a view that shows a schematic configuration of a recording apparatus according to an embodiment of the invention.

A schematic configuration of the recording apparatus 1 will be described on the basis of FIG. 1. The recording apparatus 1 is a recording apparatus that prints images on a medium P using an ink jet method while feeding the medium P. The recording apparatus 1 is provided with a medium feeding mechanism 2, a platen 3, a suction fan 4, a recording portion 5, a drying portion 6, a tension application portion 8, and a support frame 7 that supports these components.

The medium feeding mechanism 2 feeds a long form medium P to a wind-up side roll body 103 from a reel-out side roll body 101 using a roll-to-roll method. The reel-out side roll body 101 is a roll body in which the medium P is wound around a reel-out side core 101*a* (for example, a paper tube). The wind-up side roll body 103 is a roll body in which the medium P, which is reeled out from the reel-out side roll body 101 and on which an image is printed by the recording portion 5, is wound up onto a wind-up side core 103*a*. Additionally, for example, various materials, such as paper, film, or fabric, can be used as the medium P. For example, the width, diameter (linear diameter), and weight of a reel-out side roll body 101 that can be set in the recording apparatus 1 are respectively 64 inches (approximately 1.6 m), 250 mm, and 80 kg. The medium feeding mechanism 2 is provided with a reel-out portion 11, a feeding portion 12, and a wind-up portion 13.

The reel-out side roll body 101 is set in the reel-out portion 11. The reel-out portion 11 is provided with a reel-out side support portion 14, and a reel-out motor (not illustrated in the drawings). The reel-out side support portion 14 supports the reel-out side roll body 101 so as to be capable of rotating. The reel-out motor is a driving source that rotates the reel-out side roll body 101. For example, it is possible to use a DC (Direct Current) motor as the reel-out motor. As a result of the reel-out motor rotating one of normally or in reverse, the reel-out side roll body 101 is rotated in a reel-out direction D1 so that the medium P is reeled out from the reel-out side roll body 101. In addition, as a result of the reel-out motor rotating in the other of normally and in reverse, the reel-out side roll body 101 rotates in a rewind direction D2 so that the medium P is rewound onto the reel-out side roll body 101.

The feeding portion 12 feeds the medium P reeled out from the reel-out side roll body 101 toward the wind-up portion 13. The feeding portion 12 is provided with a feeding roller 16 and a feeding motor 22 (refer to FIG. 2). The feeding roller 16 is provided with a driving roller 18 and a driven roller 19. The driving roller 18 and the driven roller 19 feed the medium P in a manner in which the medium P is held therebetween. The feeding motor 22 is a driving source that rotates the driving roller 18. For example, it is possible to use a DC motor as the feeding motor 22. As a result of the feeding motor 22 rotating one of normally or in reverse, the feeding portion 12 performs a feeding operation that feeds the medium P to the downstream side, that is, in a feeding direction D3, using the feeding roller 16. In addition, as a result of the feeding motor 22 rotating the other of normally and in reverse, the feeding portion 12 performs a reverse feeding operation that feeds the medium P to the upstream side, that is, in a reverse feeding direction D4, which is a direction that is opposite to the feeding direction D3, using the feeding roller 16.

The wind-up portion 13 winds up the medium P fed thereto in roll form. The wind-up portion 13 is provided with a wind-up side support portion 15 and a wind-up motor 23 (refer to FIG. 2). The wind-up side support portion 15 supports the wind-up side core 103*a* so as to be capable of rotating. The tip end portion of the medium P is attached to the wind-up side core 103*a*. The wind-up side roll body 103 is formed as a result of the medium P being wound up onto the wind-up side core 103*a*. The wind-up motor 23 is a driving source that rotates the wind-up side roll body 103. For example, it is possible to use a DC motor as the wind-up motor 23. As a result of the wind-up motor 23 rotating one of normally or in reverse, the wind-up portion 13 performs a wind-up operation that rotates the wind-up side roll body 103 in a wind-up direction D5, and winds up the medium P onto the wind-up side roll body 103 In addition, as a result of the wind-up motor 23 rotating the other of normally and in reverse, wind-up portion 13 performs a unwinding operation that rotates the wind-up side roll body 103 in a unwinding direction D6, which is opposite to the wind-up direction, and unwinds the medium P wound up on the wind-up side roll body 103.

The platen 3 is provided further on the downstream side of a feeding pathway Pa than the feeding roller 16. A plurality of suction holes 26, which pass through the top and bottom of the platen 3, are formed in the platen 3. The suction fan 4 is provided below the platen 3. As a result of the suction fan 4 being operated, the insides of the suction holes 26 reach negative pressures, and the medium P on the platen 3 is suction held. Ink is discharged onto the medium P that is suction held on the platen 3 from a recording head 27, which will be mentioned later.

The recording portion 5 records images on the medium P. The recording portion 5 is provided with the recording head 27, a carriage 28, and a carriage movement mechanism 29. The recording head 27 discharges ink onto the medium P adsorbed onto the upper surface of the platen 3. The recording head 27 is mounted in the carriage 28. The carriage movement mechanism 29 causes the carriage 28 to reciprocate in a direction that intersects the feeding direction D3 of the medium P.

The drying portion 6 is provided further on the downstream side than the recording portion 5 in the feeding pathway Pa of the medium P that reaches from the reel-out side roll body 101 to the wind-up side roll body 103. The drying portion 6 is provided with an aluminum plate 31, and a tube heater 32 that is provided on the rear surface of the aluminum plate 31. As a result of the tube heater 32 generating heat, drying of the medium P is accelerated when the medium P, to which ink has been applied, passes over the upper surface of the aluminum plate 31.

The tension application portion 8 applies tension to the medium P as a result of coming into contact with the medium P that passes through the drying portion 6. As a result of this, the medium P is wound up by the wind-up portion 13 in a state in which an appropriate amount of tension is applied to the medium P. The tension application portion 8 is provided with a tension bar 33, and two arm members 34. The tension bar 33 is a component that directly applies tension to the medium P due to the tare weight thereof, and comes into contact with the medium P along the width direction of the medium P. The two arm members 34 are provided on a bar support shaft 35 so as to be capable of swinging, and respectively support both end portions of the tension bar 33.

In a case in which the medium P is fed in the feeding direction D3 by the feeding roller 16, or a case in which the wind-up side roll body 103 rotates in the unwinding direction D6, the tension bar 33 moves in a first direction D11, that is, downward, and the arm members 34 swing in a direction in which an angle formed with respect to a horizontal plane is decreased. On the other hand, in a case in which the medium P is fed in the reverse feeding direction D4 by the feeding roller 16, or a case in which the wind-up side roll body 103 rotates in the wind-up direction D5, the tension bar 33 moves in a second direction D12, that is, upward, and the arm members 34 swing in a direction in which an angle formed with respect to a horizontal plane is increased.

Figure 2:
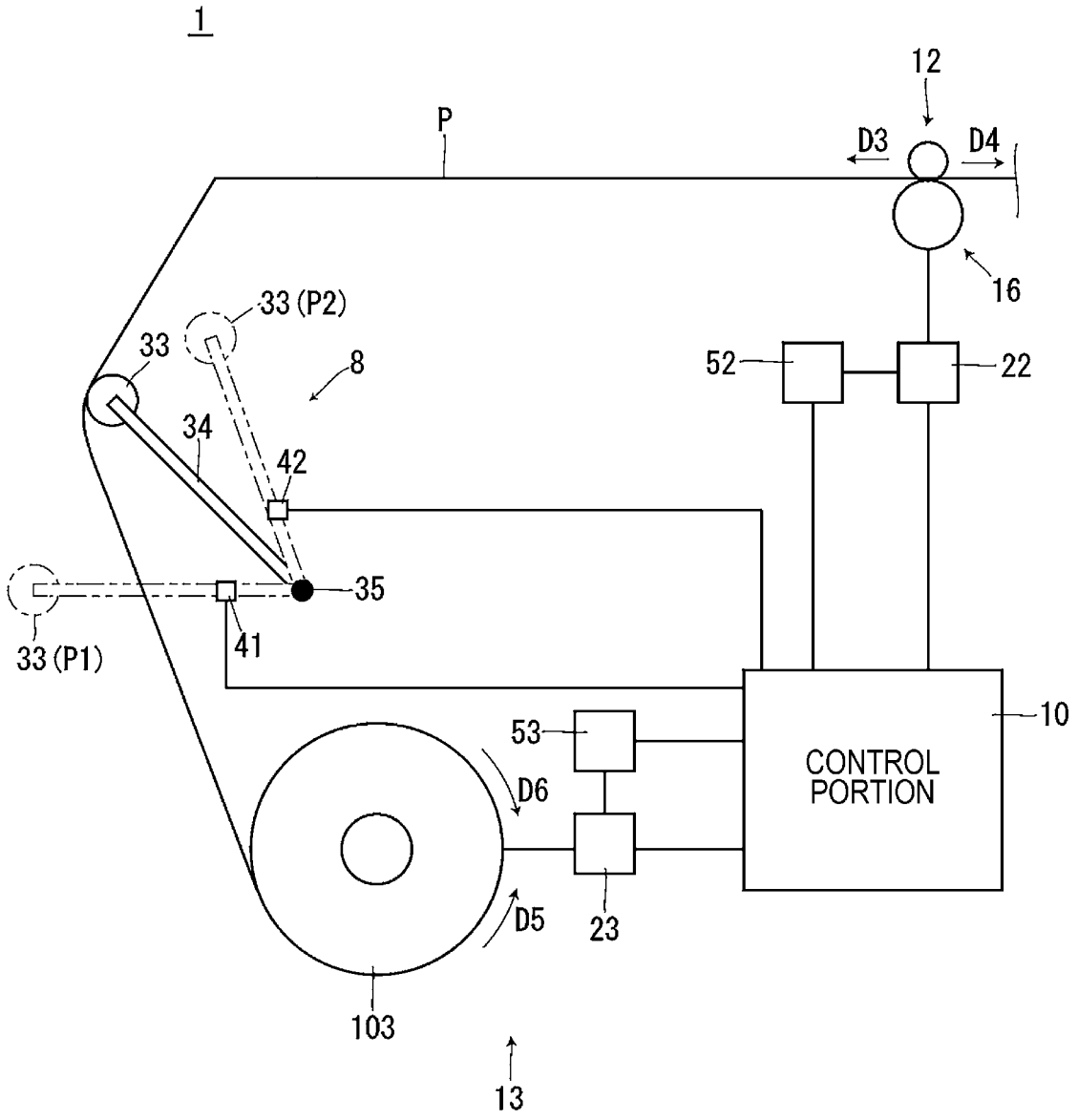
FIG. 2 is a control block diagram relating to a feeding portion, a wind-up portion, and a tension application portion of the recording apparatus.

A control configuration relating to the feeding portion 12, the wind-up portion 13, and the tension application portion 8 of the recording apparatus 1 will be described on the basis of FIG. 2. The recording apparatus 1 is provided with a control portion 10, a feeding detection portion 52, a wind-up side detection portion 53, a first bar detection portion 41, and a second bar detection portion 42.

The control portion 10 performs integrated control of each portion of the recording apparatus 1. Although illustration is omitted from the drawings, the control portion 10 is provided with a central processing unit (CPU), read only memory (ROM), random access memory (RAM), programmable ROM (PROM), an application specific integrated circuit (ASIC), a driver, and a bus.

In addition, a host device (for example, a personal computer), which is not illustrated in the drawings, is connected to the control portion 10 in a manner in which communication can be performed. When a recording job is received from the host device, the control portion 10 controls each portion of the recording apparatus 1 on the basis of the received recording job. As a result of this, the recording apparatus 1 performs alternate repetition of a dot formation operation and the feeding operation. In this instance, the dot formation operation is an operation that forms dots on the medium P by discharging an ink from the recording head 27 while moving the carriage 28 in a direction that intersects the feeding direction D3.

The feeding detection portion 52 detects a feeding amount of the medium P by the feeding operation and a reverse feeding amount of the medium P by the reverse feeding operation. For example, it is possible to use a rotary encoder provided in the feeding motor 22 as the feeding detection portion 52. The rotational position of the feeding motor 22 is expressed as a count value of an output pulse from the feeding detection portion 52, and the feeding amount and reverse feeding amount are detected on the basis of the amount of change in the rotational position (the rotational amount of the feeding motor 22).

The wind-up side detection portion 53 detects a wind-up amount of the medium P by the wind-up operation and a unwinding amount of the medium P by the unwinding operation. For example, it is possible to use a rotary encoder provided in the wind-up motor 23 as the wind-up side detection portion 53. The rotational position of the wind-up motor 23 is expressed as a count value of an output pulse from the wind-up side detection portion 53, and the wind-up amount and the unwinding amount are detected on the basis of the amount of change in the rotational position (the rotational amount of the wind-up motor 23).

When the unwinding amount of the medium P is set as A, for example, the control portion 10 calculates the unwinding amount A using Equation (1).

$$A = d \times \pi \times (\theta/360) \quad (1)$$

In Equation (1), d is the linear diameter of the wind-up side roll body 103. For example, the linear diameter d is calculated in advance on the basis of the rotational amount of the feeding motor 22 that is detected by the feeding detection portion 52 and the rotational amount of the wind-up motor 23 that is detected by the wind-up side detection portion 53 in a recording job that is executed immediately before the unwinding operation. In addition, in Equation (1), θ is a rotational amount [°] of the wind-up side roll body 103 by the unwinding operation. For example, the rotational amount θ is calculated on the basis of the rotational amount of the wind-up motor 23 after the initiation of the unwinding operation, which is detected by the wind-up side detection portion 53 every predetermined amount of time during the unwinding operation.

The first bar detection portion 41 detects whether or not the tension bar 33 is positioned in a first position P1. The first position P1 of the tension bar 33 is a position at which the arm members 34, which support the tension bar 33, form a predetermined first angle with respect to a horizontal plane. Additionally, the first angle may be 0°. For example, as the first bar detection portion 41, it is possible to use a photointerrupter that is provided so that detected light is blocked by the arm members 34, which support the tension bar 33, when the tension bar 33 moves to the first position P1. Additionally, due to a stopper, which is not illustrated in the drawings, the tension bar 33 does not move further than the first position P1 in the first direction D11, but the invention is not limited to this configuration, and the tension bar 33 may also be capable of moving further than the first position P1 in the first direction D11.

The second bar detection portion 42 detects whether or not the tension bar 33 is positioned in a second position P2. The second position P2 of the tension bar 33 is a position at which the arm members 34, which support the tension bar 33, form a predetermined second angle, which is larger than the first angle, with respect to a horizontal plane. For example, as the second bar detection portion 42, it is possible to use a photointerrupter that is provided so that detected light is blocked by the arm members 34, which support the tension bar 33, when the tension bar 33 moves to the second position P2. Additionally, the tension bar 33 is capable of moving further than the second position P2 in the second direction D12.

In the recording apparatus 1, which is configured in this manner, the wind-up operation of the wind-up portion 13 is performed so that the medium P fed in the feeding direction D3 by the feeding operation of the feeding portion 12 does not become slack between the feeding roller 16 and the wind-up side roll body 103. At this time, the control portion 10 controls the wind-up motor 23 in accordance with the position of the tension bar 33 so that an appropriate amount of the medium fed in the feeding direction D3 by the feeding roller 16 is wound up onto the wind-up side roll body 103. In other words, the control portion 10 controls the wind-up motor 23 so that the tension bar 33 moves between the first position P1 and the second position P2 during the execution of a recording job.

Figure 3:
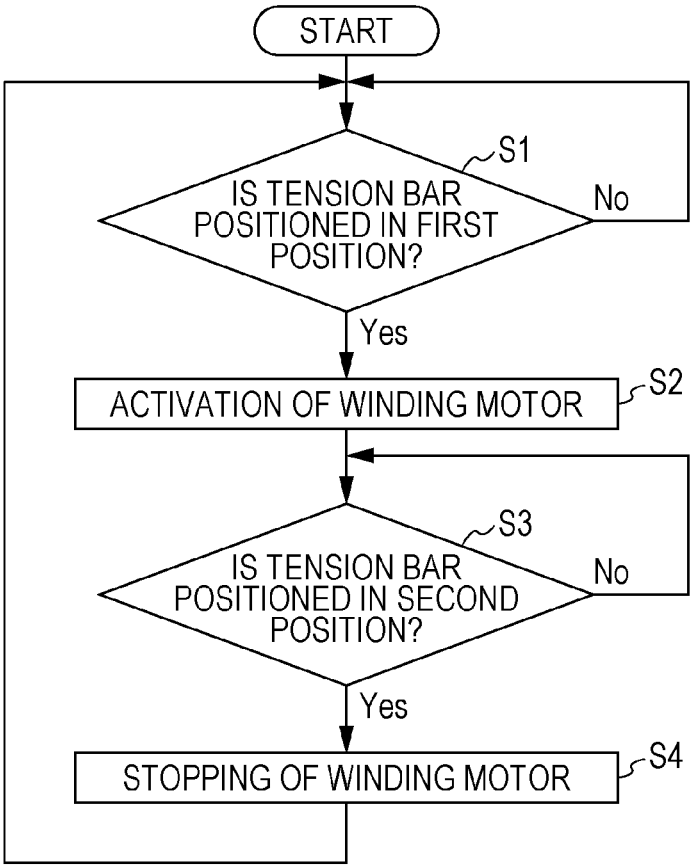
FIG. 3 is a flowchart that shows a control flow of a wind-up operation.

A control flow of the wind-up operation will be described on the basis of FIG. 3. The control portion 10 performs the control flow of the wind-up operation during the execution of a recording job.

In Step S1, the control portion 10 determines whether or not the tension bar 33 is positioned in the first position P1 on the basis of a detection result of the first bar detection portion 41. In a case in which it is determined that the tension bar 33 is positioned in the first position P1 (S1; Yes), the control portion 10 proceeds to Step S2. On the other hand, in a case in which it is determined that the tension bar 33 is not positioned in the first position P1 (S1; No), the control portion 10 repeats Step S1 until it is determined that the tension bar 33 is positioned in the first position P1.

In Step S2, the control portion 10 activates the wind-up motor 23 so that the wind-up side roll body 103 rotates in the wind-up direction D5.

In Step S3, the control portion 10 determines whether or not the tension bar 33 is positioned in the second position P2 on the basis of a detection result of the second bar detection portion 42. In a case in which it is determined that the tension bar 33 is positioned in the second position P2 (S3; Yes), the control portion 10 proceeds to Step S4. On the other hand, in a case in which it is determined that the tension bar 33 is not positioned in the second position P2 (S3; No), the control portion 10 repeats Step S3 until it is determined that the tension bar 33 is positioned in the second position P2.

In Step S4, the control portion 10 stops the wind-up motor 23. Thereafter, the control portion 10 returns to Step S1.

Figure 4:
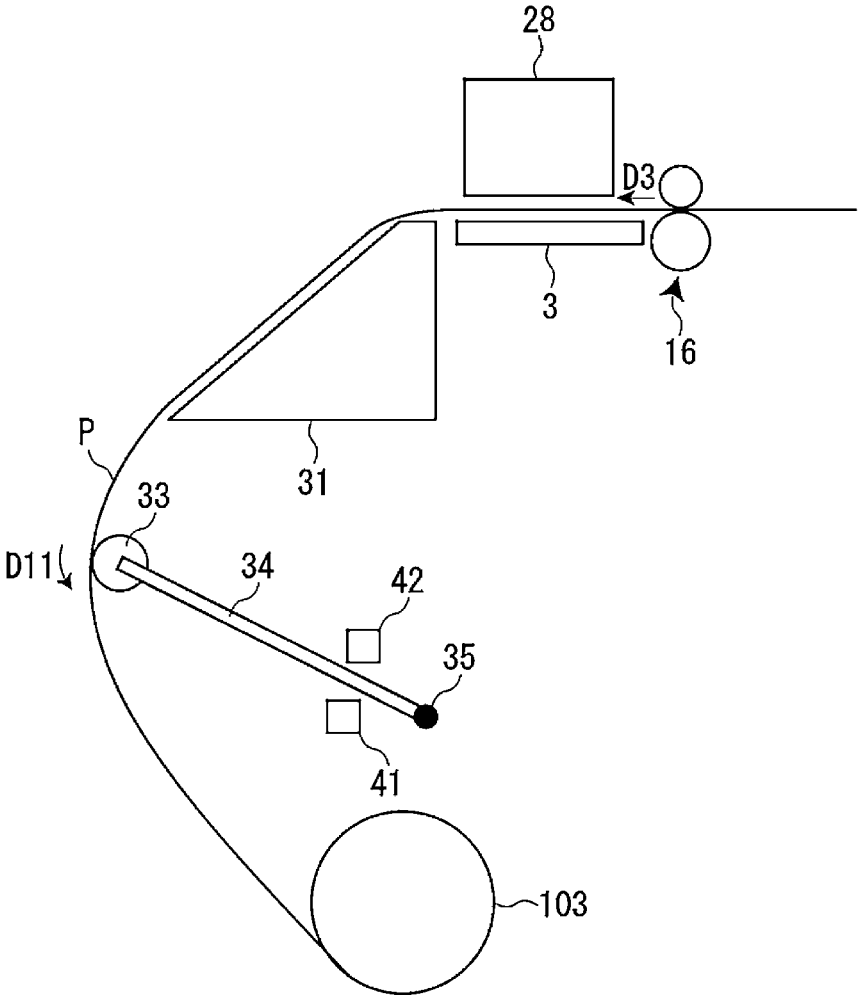
FIG. 4 is a view for describing the wind-up operation.
Figure 5:
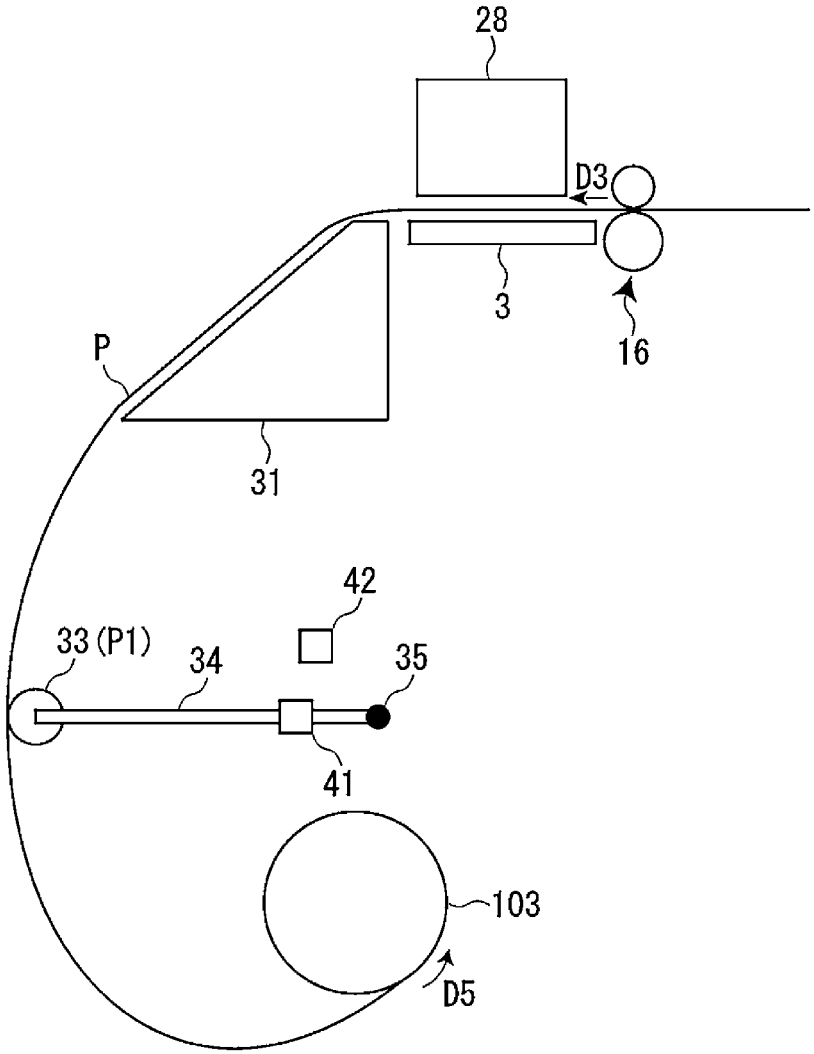
FIG. 5 is a view for describing the wind-up operation continuing from FIG. 4.
Figure 6:
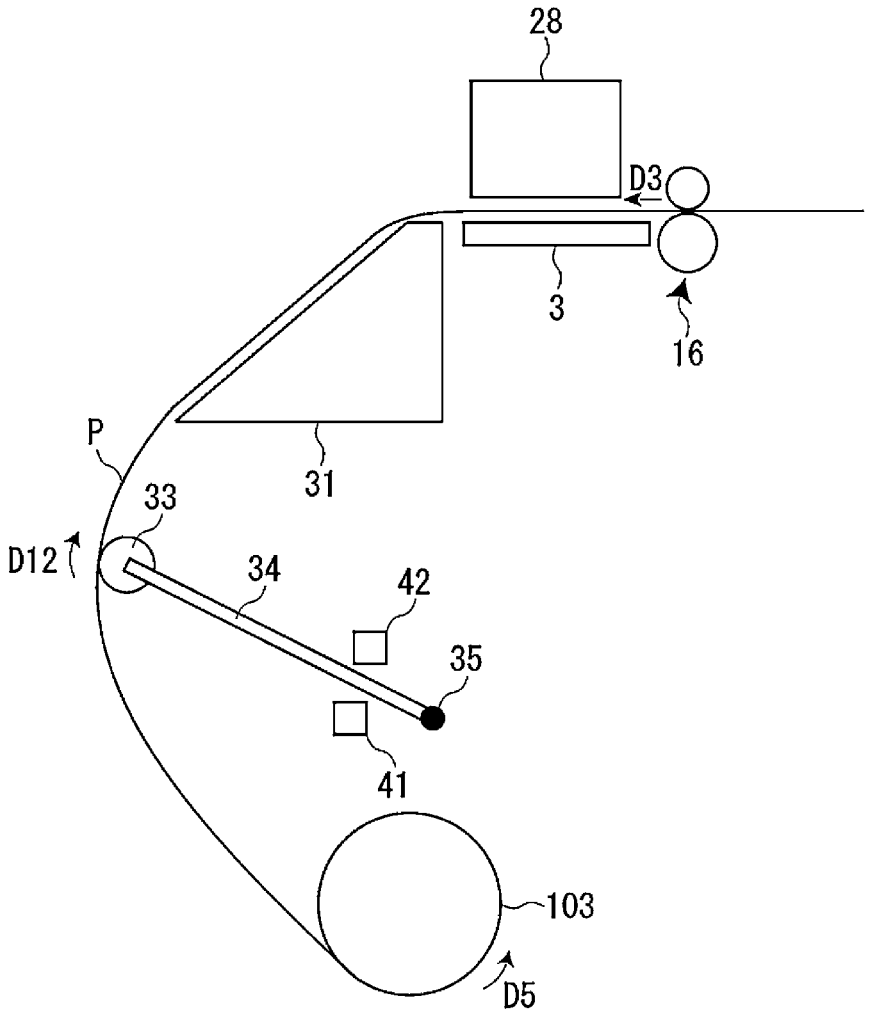
FIG. 6 is a view for describing the wind-up operation continuing from FIG. 5.
Figure 7:
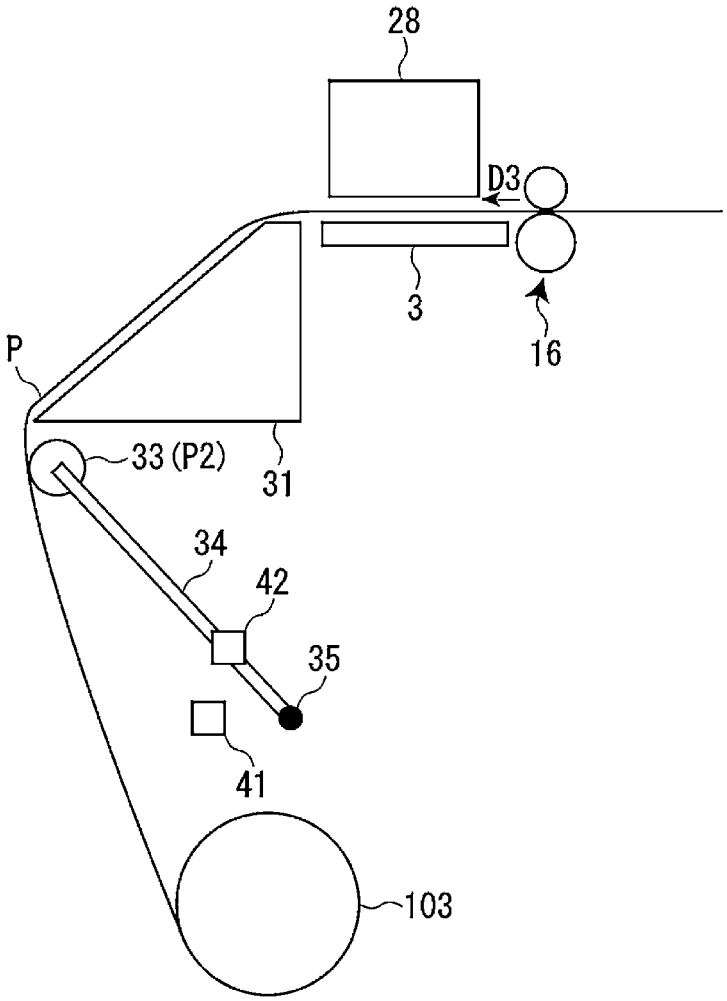
FIG. 7 is a view for describing the wind-up operation continuing from FIG. 6.

The wind-up operation will be described on the basis of FIGS. 4 to 7 while referring to FIG. 3. As shown in FIG. 4, the feeding operation is performed intermittently during a recording job, and when the medium P is fed in the feeding direction D3 by the feeding roller 16, the tension bar 33 moves in the first direction D11. Subsequently, as shown in FIG. 5, when the tension bar 33 reaches the first position P1 (S1; Yes), the wind-up motor 23 is activated (S2) in a manner in which the wind-up side roll body 103 rotates in the wind-up direction D5. As a result of this, as shown in FIG. 6, the medium P is wound up onto the wind-up side roll body 103, and the tension bar 33 moves in the second direction D12. Further, as shown in FIG. 7, when the tension bar 33 reaches the second position P2 (S3; Yes), the wind-up motor 23 is stopped (S4).

On the other hand, in the recording apparatus 1, in a case in which the reverse feeding operation of the feeding portion 12 is performed in order to cue the medium P with respect to the recording portion 5, the unwinding operation of the wind-up portion 13 is performed so that the medium P is not pulled taut between the feeding roller 16 and the wind-up side roll body 103.

A control flow of the unwinding operation, which is a Reference Example of the invention, will be described on the basis of FIG. 8. The control portion 10 performs the control flow of the unwinding operation according to the Reference Example during the reverse feeding operation.

In Step S101, the control portion 10 determines whether or not the tension bar 33 is positioned in the second position P2 on the basis of a detection result of the second bar detection portion 42. In a case in which it is determined that the tension bar 33 is positioned in the second position P2 (S101; Yes), the control portion 10 proceeds to Step S102. On the other hand, in a case in which it is determined that the tension bar 33 is not positioned in the second position P2 (S101; No), the control portion 10 repeats Step S101 until it is determined that the tension bar 33 is positioned in the second position P2.

In Step S102, the control portion 10 activates the wind-up motor 23 so that the wind-up side roll body 103 rotates in the unwinding direction D6.

In Step S103, the control portion 10 determines whether or not the tension bar 33 is positioned in the first position P1 on the basis of a detection result of the first bar detection portion 41. In a case in which it is determined that the tension bar 33 is positioned in the first position P1 (S103; Yes), the control portion 10 proceeds to Step S104. On the other hand, in a case in which it is determined that the tension bar 33 is not positioned in the first position P1 (S103; No), the control portion 10 repeats Step S103 until it is determined that the tension bar 33 is positioned in the first position P1.

In Step S104, the control portion 10 stops the wind-up motor 23. Thereafter, the control portion 10 returns to Step S101.

Figure 9:
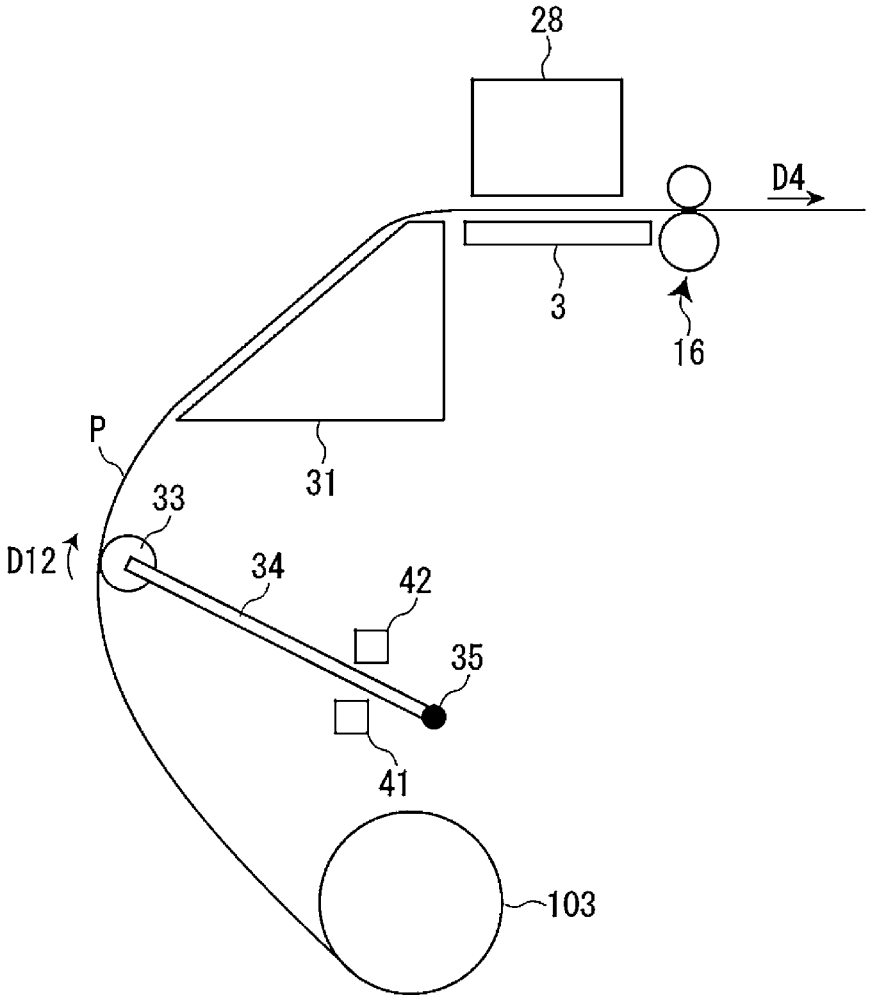
FIG. 9 is a view for describing the unwinding operation in the Reference Example.
Figure 10:
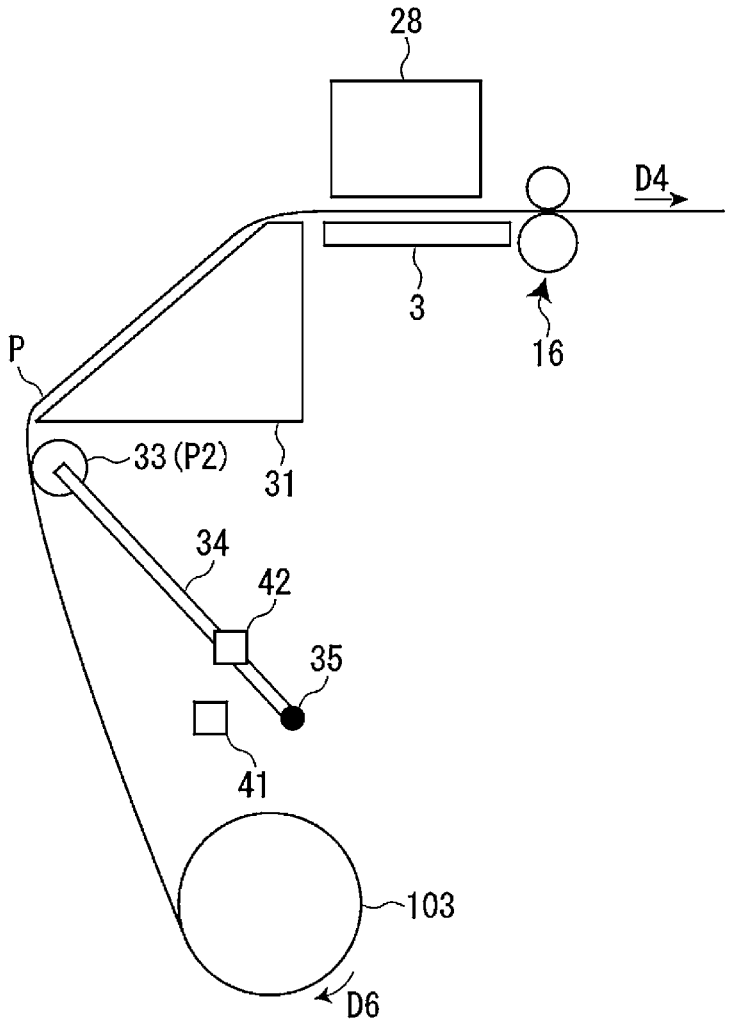
FIG. 10 is a view for describing the unwinding operation in the Reference Example continuing from FIG. 9.
Figure 11:
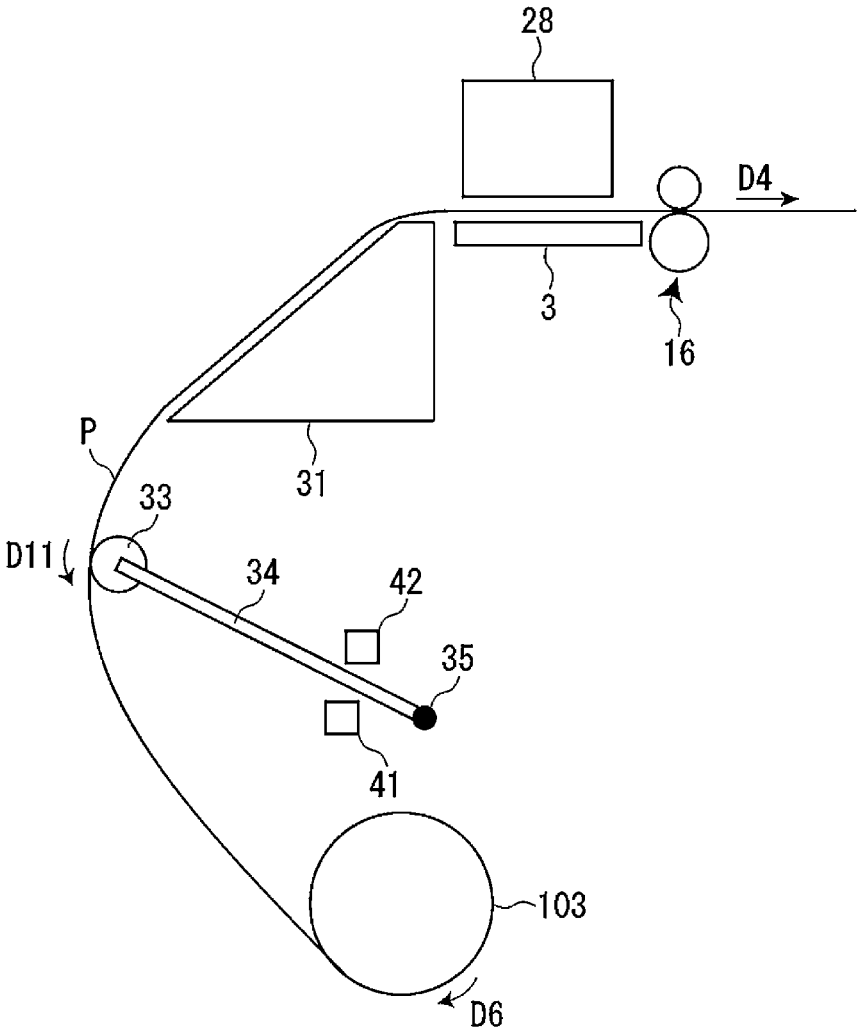
FIG. 11 is a view for describing the unwinding operation in the Reference Example continuing from FIG. 10.
Figure 12:
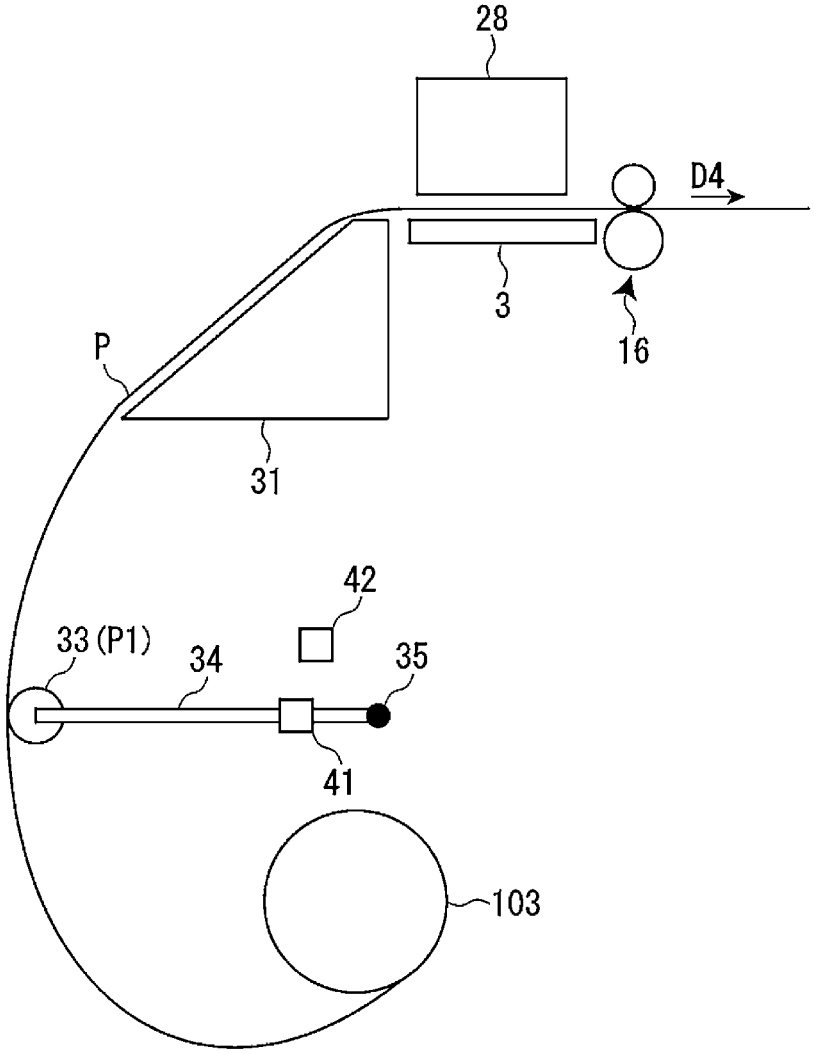
FIG. 12 is a view for describing the unwinding operation in the Reference Example continuing from FIG. 11.

The unwinding operation according to the Reference Example will be described on the basis of FIGS. 9 to 12 while referring to FIG. 8. As shown in FIG. 9, when the medium P is fed in the reverse feeding direction D4 by the feeding roller 16, the tension bar 33 moves in the second direction D12. Subsequently, as shown in FIG. 10, when the tension bar 33 reaches the second position P2 (S101; Yes), the wind-up motor 23 is activated (S102) in a manner in which the wind-up side roll body 103 rotates in the unwinding direction D6. As a result of this, as shown in FIG. 11, the medium P is unwound from the wind-up side roll body 103, and the tension bar 33 moves in the first direction D11. Further, as shown in FIG. 12, when the tension bar 33 reaches the first position P1 (S103; Yes), the wind-up motor 23 is stopped (S104).

In this manner, the unwinding operation according to the Reference Example is initiated when the tension bar 33 initially reaches the second position P2 after the reverse feeding operation of the feeding portion 12 has been initiated. However, when performing the unwinding operation after the tension bar 33 reaches the second position P2 in this manner, there are cases in which the unwinding amount of the medium P by the unwinding operation does not draw level with the reverse feeding amount of the medium P by the reverse feeding operation, and therefore, the tension bar 33 moves further upward than the second position P2. In this case, since it is not possible for the weight of the tension bar 33 to sufficiently act on the medium P between the feeding roller 16 and the wind-up side roll body 103, the medium P between the feeding roller 16 and the wind-up side roll body 103 attains a pulled taut state, that is, a state in which the medium P that is reeled out from the wind-up side roll body 103 is directly pulled by the feeding roller 16, and there is a concern that it will not be possible for the feeding portion 12 to suitably perform the reverse feeding operation. In such an instance, the recording apparatus 1 of the present embodiment performs the unwinding operation before the reverse feeding operation.

A control flow of the unwinding operation according to the embodiment will be described on the basis of FIG. 13. The control portion 10 performs the control flow of the unwinding operation after a trigger for the reverse feeding operation is acquired but before the reverse feeding operation is initiated.

In Step S11, the control portion 10 activates the wind-up motor 23 so that the wind-up side roll body 103 rotates in the unwinding direction D6.

In Step S12, the control portion 10 determines whether or not the tension bar 33 is positioned in the first position P1 on the basis of a detection result of the first bar detection portion 41. In a case in which it is determined that the tension bar 33 is positioned in the first position P1 (S12; Yes), the control portion 10 proceeds to Step S14. On the other hand, in a case in which it is determined that the tension bar 33 is not positioned in the first position P1 (S12; No), the control portion 10 proceeds to Step S13.

In Step S13, the control portion 10 determines whether or not the unwinding amount A detected by the wind-up side detection portion 53 exceeds a threshold value B. In this instance, the threshold value B is the reverse feeding amount of the medium P by the feeding portion 12, which is set in advance.

In a case in which it is determined that unwinding amount A exceeds the threshold value B (S13; Yes), the control portion 10 proceeds to Step S14. On the other hand, in a case in which it is determined that unwinding amount A does not exceed the threshold value B (S13; No), the control portion 10 returns to Step S12.

In Step S14, the control portion 10 stops the wind-up motor 23. After the control flow of the unwinding operation in is finished in this manner, the control portion 10 activates the feeding motor 22 so that the medium P is fed in the reverse feeding direction D4.

Figure 14:
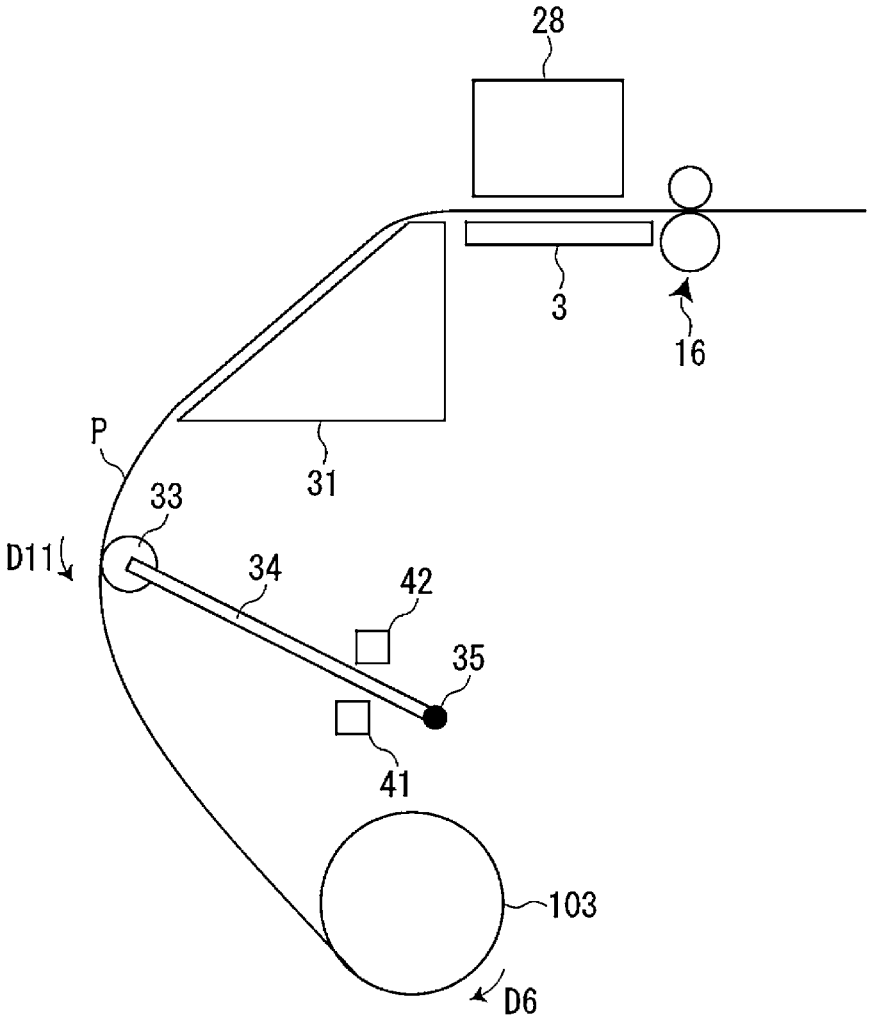
FIG. 14 is a view for describing a unwinding operation according to the embodiment.
Figure 15:
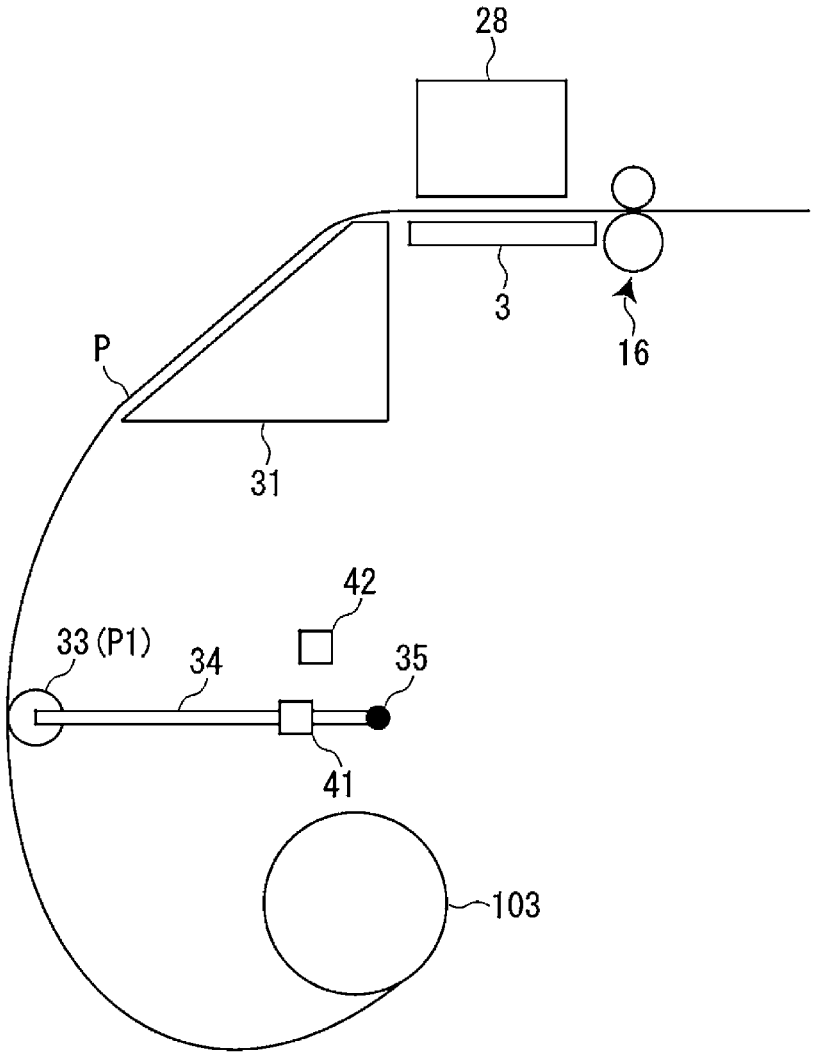
FIG. 15 is a view for describing the unwinding operation according to the embodiment continuing from FIG. 14.

The unwinding operation and the reverse feeding operation that is performed after the unwinding operation according to the embodiment will be described on the basis of FIGS. 14 to 19 while referring to FIG. 13. As shown in FIG. 14, when the wind-up motor 23 is activated so that the wind-up side roll body 103 rotates in the unwinding direction D6 (S11), the medium P is unwound from the wind-up side roll body 103, and the tension bar 33 moves in the first direction D11. Subsequently, as shown in FIG. 15, when the tension bar 33 reaches the first position P1 (S12; Yes), the wind-up motor 23 is stopped (S14). As a result of this, an excessive amount of unwinding of the medium P from the wind-up portion 13 is suppressed and therefore, a circumstance in which the medium P droops down from the wind-up side roll body 103 is suppressed.

Figure 16:
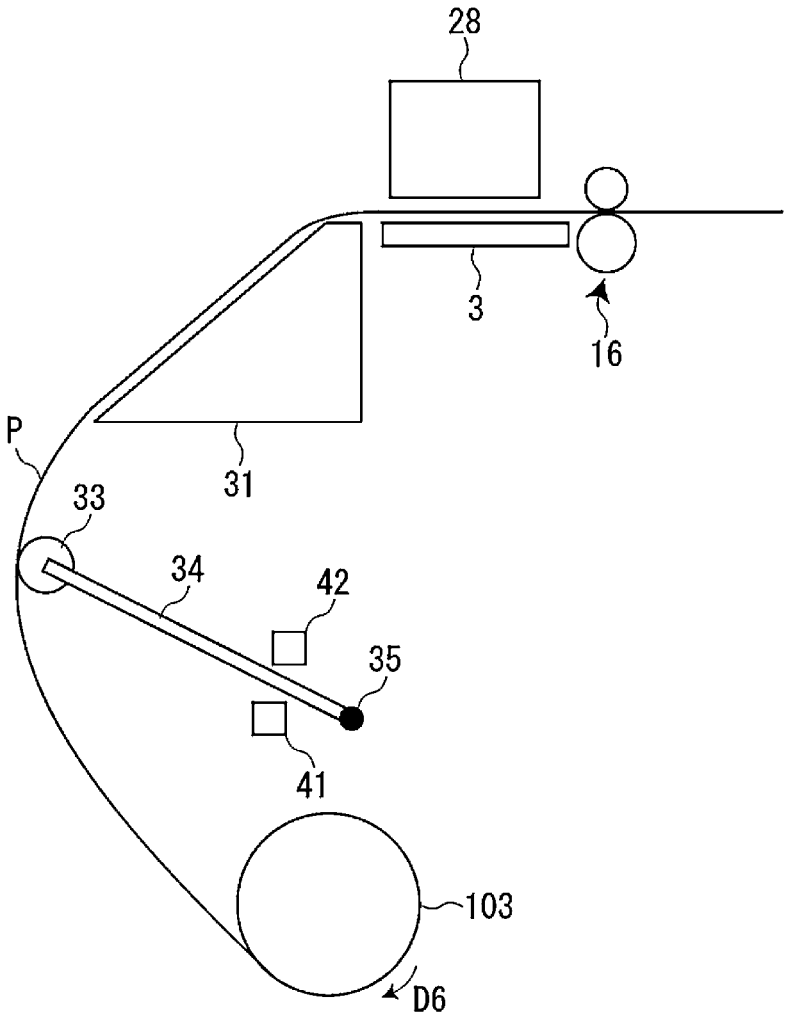
FIG. 16 is a view for describing the unwinding operation according to the embodiment continuing from FIG. 15.
Figure 17:
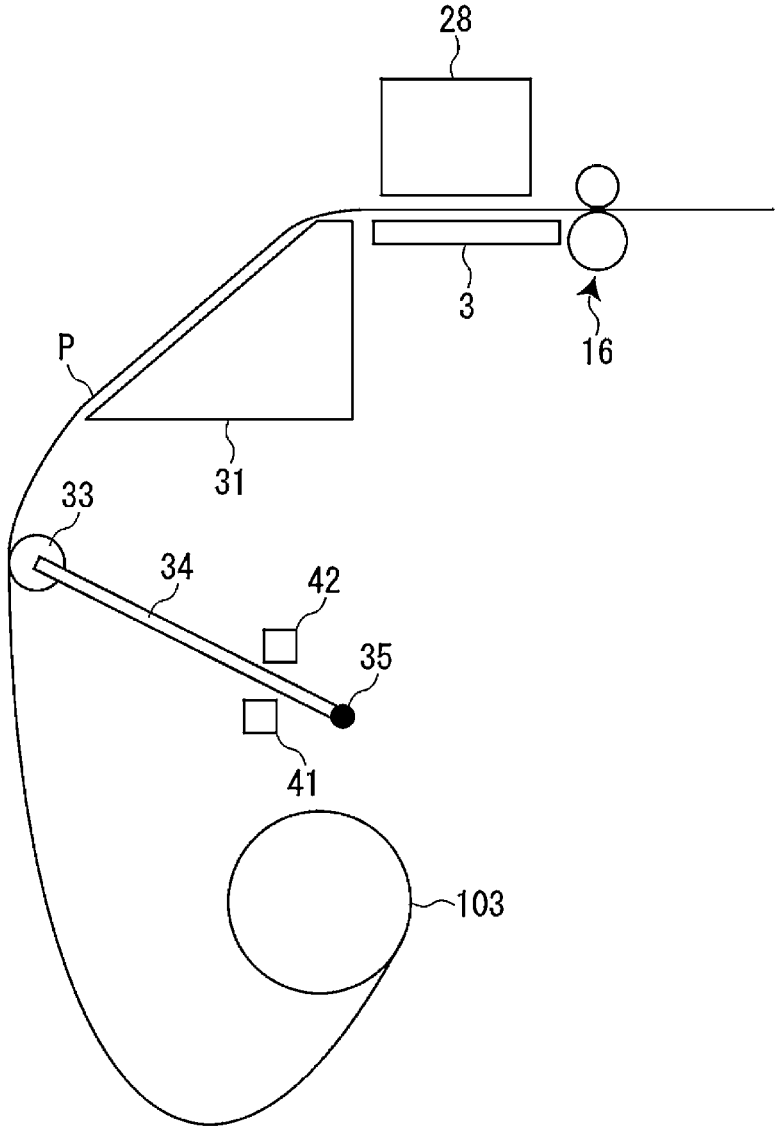
FIG. 17 is a view for describing the unwinding operation according to the embodiment continuing from FIG. 16.

In addition, as shown in FIG. 16, there are cases in which the tension bar 33 does not move in the first direction D11 even if the medium P is unwound from the wind-up side roll body 103. For example, it is considered that the cause of this is that the medium P shrinks as a result of the temperature falling at a position of the tension bar 33 after being heated at a position of the drying portion 6, and as a result, it is as if the medium P is gripped by the tension bar 33. Even in such a case, as shown in FIG. 17, when the unwinding amount A exceeds the threshold value B, that is, the reverse feeding amount of the medium P (S13), the wind-up motor 23 is stopped (S14). As a result of this, an excessive amount of unwinding of the medium P from the wind-up portion 13 is suppressed and therefore, a circumstance in which the medium P droops down from the wind-up side roll body 103 is suppressed.

Figure 18:
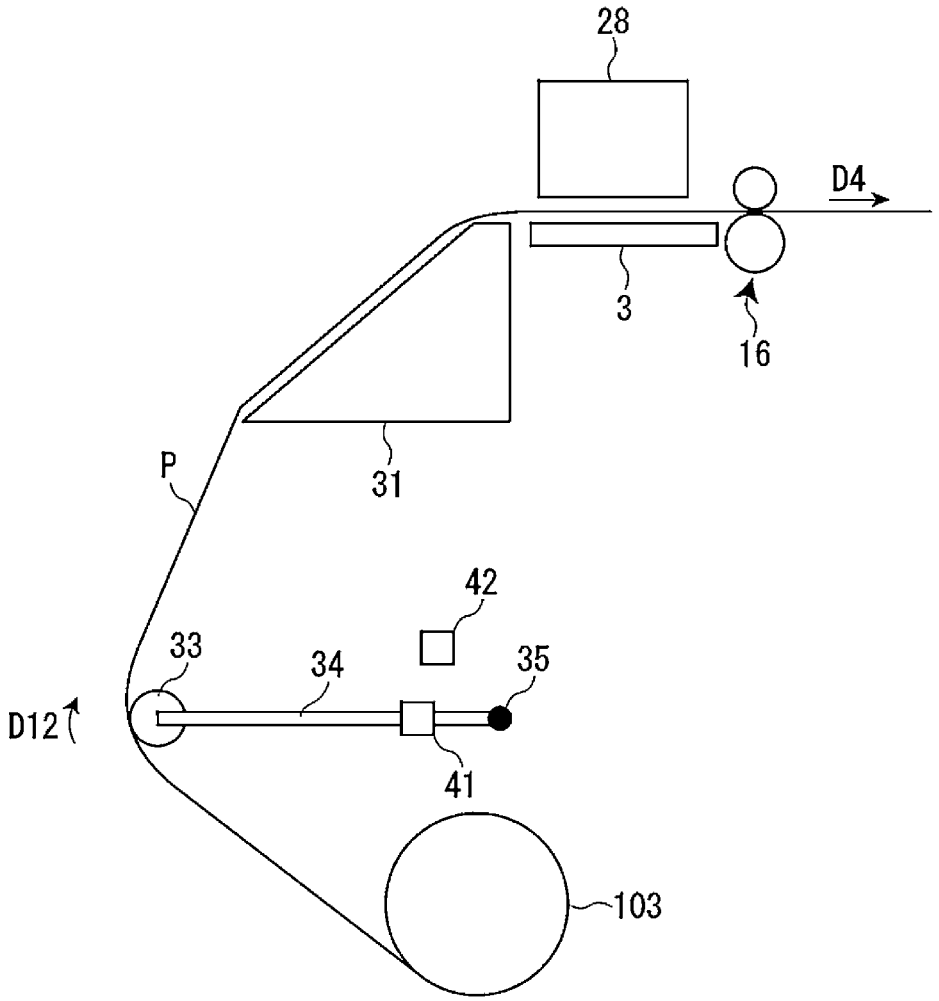
FIG. 18 is a view for describing a reverse feeding operation that is performed after the unwinding operation.
Figure 19:
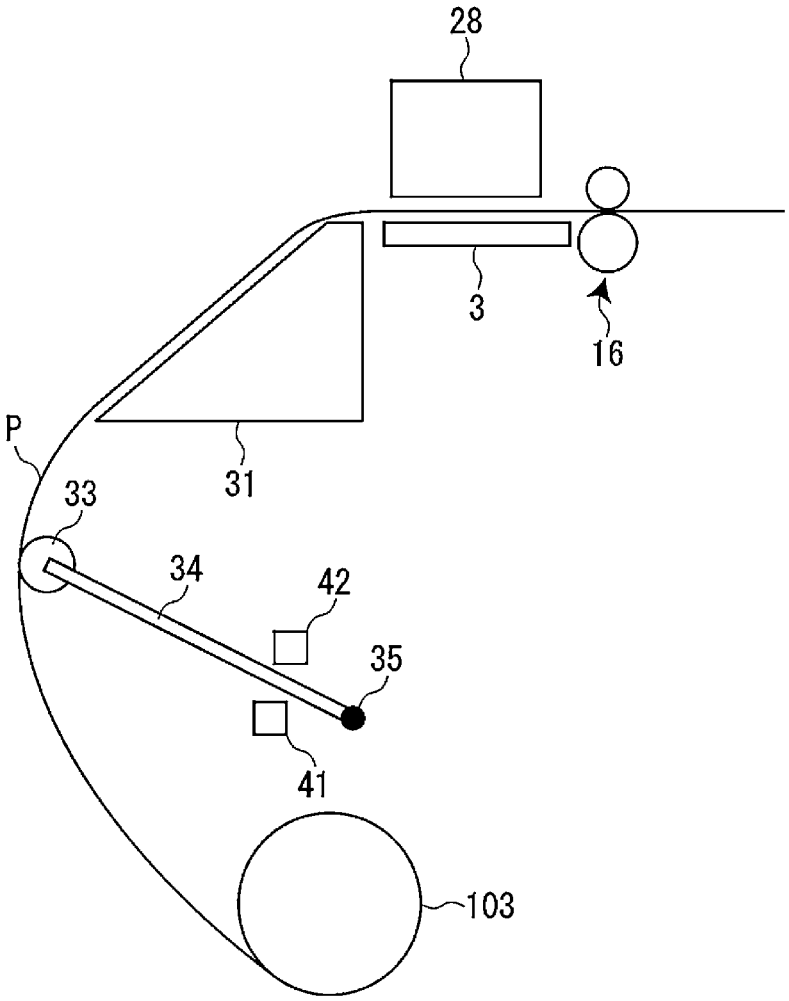
FIG. 19 is a view for describing the reverse feeding operation that is performed after the unwinding operation continuing from FIG. 18.

As shown in FIG. 18, after the wind-up motor 23 is stopped, when the feeding motor 22 is activated so that the medium P is fed in the reverse feeding direction D4, the medium P is fed in the reverse feeding direction by the feeding roller 16, sagging of the medium P is resolved, and the tension bar 33 moves in the second direction D12. Further, as shown in FIG. 19, the reverse feeding amount of the medium P reaches a set value and the feeding motor 22 is stopped before the tension bar 33 reaches the second position P2.

In this manner, the unwinding operation according to the embodiment is performed prior to the reverse feeding operation of the feeding portion 12. Therefore, as a result of the unwinding operation, the reverse feeding operation is initiated in a state in which the medium P has been unwound from the wind-up side roll body 103. Therefore, a circumstance in which the tension bar 33 moves further upward than the second position P2 during the reverse feeding operation is suppressed, and therefore, a circumstance in which the medium P between the feeding roller 16 and the wind-up side roll body 103 attains a pulled taut state is suppressed.

In the above-mentioned manner, the recording apparatus 1 of the present embodiment is provided with the feeding portion 12 and the wind-up portion 13. The feeding portion 12 performs the feeding operation, which feeds the medium P to the downstream side, and the reverse feeding operation, which feeds the medium P to the upstream side. The wind-up portion 13 performs the wind-up operation, which winds up the medium P fed to the downstream side by the feeding operation, and the unwinding operation, which unwinds the wound up medium P. Further, the wind-up portion 13 performs the unwinding operation prior to the reverse feeding operation.

According to this configuration, the reverse feeding operation is initiated in a state in which the medium P has been unwound by the unwinding operation. Accordingly, it is possible to suppress a circumstance in which the medium between the feeding portion 12 and the wind-up portion 13 attains a pulled taut state when the feeding portion 12 performs the reverse feeding operation.

In addition, the recording apparatus 1 of the present embodiment is provided with a wind-up side detection portion 53 that detects the unwinding amount A of the medium P by the unwinding operation. Further, the wind-up portion 13 stops the unwinding operation in a case in which the detected unwinding amount A exceeds the threshold value B, which is based on the reverse feeding amount of the medium P by the reverse feeding operation.

According to this configuration, it is possible to suppress a circumstance in which an excessive amount of the medium P is unwound from the wind-up portion 13.

In addition, in the recording apparatus 1 of the present embodiment, the tension bar 33 and the first bar detection portion 41 are provided. The tension bar 33 applies tension to the medium P between the feeding portion 12 and the wind-up portion 13, and moves toward the first position P1 when the unwinding operation is performed. The first bar detection portion 41 detects the position of the tension bar 33. Further, the wind-up portion 13 stops the unwinding operation in a case in which it is detected by the first bar detection portion 41 that the tension bar 33 has reached the first position P1.

According to this configuration, it is possible to suppress a circumstance in which an excessive amount of the medium P is unwound from the wind-up portion 13.

In addition, in the recording apparatus 1 of the present embodiment, the wind-up portion 13 stops the unwinding operation in a case in which it is detected by the first bar detection portion 41 that the tension bar 33 has reached the first position P1, and in a case in which the detected unwinding amount A exceeds the threshold value B, which is based on the reverse feeding amount of the medium P by the reverse feeding operation, even if it is not detected by the first bar detection portion 41 that the tension bar 33 has reached the first position P1.

According to this configuration, even in a case in which the tension bar 33 does not move toward the first position P1 when the medium P is unwound from the wind-up portion 13, the unwinding operation is stopped at a point in time at which the detected unwinding amount A exceeds the threshold value B. Accordingly, it is possible to suppress a circumstance in which an excessive amount of the medium P is unwound from the wind-up portion 13.

Figure 8:
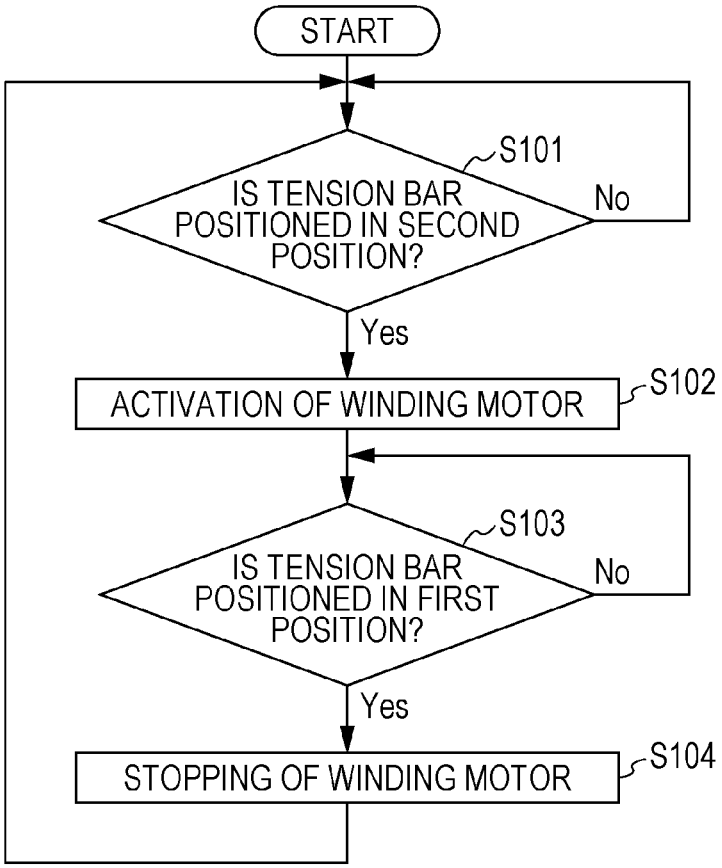
FIG. 8 is a flowchart that shows a control flow of a unwinding operation in a Reference Example.
Figure 13:
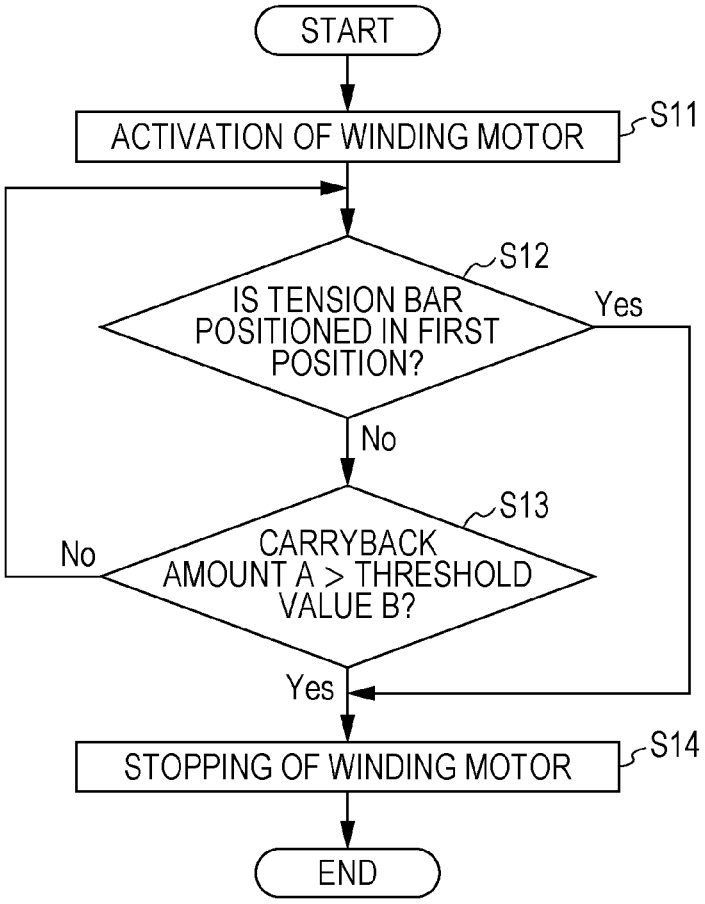
FIG. 13 is a flowchart that shows a control flow of a unwinding operation according to the embodiment.

In addition, in a case in which the unwinding operation is continuously performed, as an initial operation, the control flow shown in FIG. 13 may be performed, and thereafter, the control flow of the unwinding operation shown in FIG. 8 may be repeated thereafter.

Additionally, the tension bar 33 is an example of a "tension member". The first position P1 is an example of a "unwinding stopping position". The wind-up side detection portion 53 is an example of a "unwinding amount detection portion". The first bar detection portion 41 is an example of a "position detection portion".

The invention is not limited to the above-mentioned embodiment, and naturally, can adopt various configurations within a range in which that does not depart from the aim thereof. For example, the invention can be altered to have a format such as that below.

In the control flow of the unwinding operation, it is not necessary for the control portion 10 to perform both the determination of whether or not the tension bar 33 is positioned in the first position P1, and the determination of whether or not the unwinding amount A of the medium P by the unwinding operation examples the threshold value B, and the control portion 10 may perform either one only.

In a case in which the wind-up motor 23 is a stepping motor, the control portion 10 may detect the unwinding amount A on the basis of a pulse number output to the wind-up motor 23. That is, the recording apparatus 1 may cause the control portion 10 to function as a "unwinding amount detection portion".

The threshold value B is not limited to the actual reverse feeding amount of the medium P by the feeding portion 12, and may be a value that is based on the reverse feeding amount. For example, the threshold value B may be a value obtained by multiplying the reverse feeding amount by a predetermined coefficient, a value obtained by adding a predetermined value to the reverse feeding amount, or a value obtained by subtracting a predetermined value from the reverse feeding amount.

The recording apparatus 1 may be provided with an angle sensor that detects a swing angle of the arm members 34 in place of the first bar detection portion 41 and the second bar detection portion 42. For example, it is possible to use a rotary encoder as the angle sensor. That is, the recording apparatus 1 may cause the angle sensor to function as a "position detection portion".

Application examples of the medium feeding apparatus of the invention are not limited to an ink jet method recording apparatus, and for example, may also be a dot impact method recording apparatus, or an electrophotographic method recording apparatus. Furthermore, the invention is not limited to recording apparatuses and for example, the medium feeding apparatus of the invention may also be applied to a drying device that carries out a drying treatment on a medium while feeding the medium, or a surface treatment device that carries out a surface treatment on a medium while feeding the medium. In addition, the invention is not limited to a device that carries out such a process on a medium, and may also be applied to a device the merely feeds a medium.

This application claims priority under 35 U.S.C. § 119 to Japanese Patent Application No. 2016-063264, filed Mar. 28, 2016. The entire disclosure of Japanese Patent Application No. 2016-063264 is hereby incorporated herein by reference.

What is claimed is:

1. A medium feeding apparatus comprising:

a feeding portion that performs a feeding operation, which feeds a medium in a first direction to a downstream side, and a reverse feeding operation, which feeds the medium in a second direction to an upstream side, the feeding portion including a first motor that is configured to cause the feeding portion to rotate when performing the feeding operation and the reverse feeding operation; and a wind-up portion that performs a wind-up operation, which winds up a medium fed in the first direction to the downstream side by the feeding operation, and a unwinding operation, which unwinds the wound up medium, the wind-up portion including a second motor that is configured to cause the wind-up portion to rotate when performing the wind-up operation and the unwinding operation, wherein the wind-up portion performs the unwinding operation prior to the reverse feeding operation, and wherein the reverse feeding operation includes the feeding portion rotating in the second direction that feeds the medium to the upstream side, and wherein the feeding portion starts rotating in the second direction that feeds the medium to the upstream side only after the wind-up portion has stopped rotating in a direction that unwind the wound up medium.

2. The medium feeding apparatus according to claim 1, further comprising:

an unwinding amount detection portion that detects an unwinding amount of the medium by the unwinding operation, wherein a controller of the feeding apparatus causes the wind-up portion to stop the unwinding operation when the controller determines that the unwinding amount detected by the unwinding amount detection portion exceeds a threshold value, which is based on a predetermined reverse feeding amount of the medium by the reverse feeding operation.

3. The medium feeding apparatus according to claim 1, further comprising:

a tension member that applies tension to the medium between the feeding portion and the wind-up portion, and moves toward an unwinding stopping position when the unwinding operation is performed; and a position detection portion that detects the position of the tension member, wherein the wind-up portion stops the unwinding operation in a case in which it is detected by the position detection portion that the tension member has reached the unwinding stopping position.

4. The medium feeding apparatus according to claim 1, further comprising:

an unwinding amount detection portion that detects an unwinding amount of the medium by the unwinding operation;

a tension member that applies tension to the medium between the feeding portion and the wind-up portion, and moves toward an unwinding stopping position when the unwinding operation is performed; and a position detection portion that detects the position of the tension member, wherein the wind-up portion stops the unwinding operation in a case in which it is detected by the position detection portion that the tension member has reached the unwinding stopping position, and in a case in which a controller of the feeding apparatus determines that the unwinding amount detected by the unwinding amount detection portion exceeds a threshold value, which is based on a predetermined reverse feeding amount of the medium by the reverse feeding operation.

* * * * *